US006898386B2

(12) United States Patent
Takigawa

(10) Patent No.: US 6,898,386 B2
(45) Date of Patent: May 24, 2005

(54) BELT APPARATUS AND IMAGE FORMING APPARATUS

(75) Inventor: Junya Takigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/404,125

(22) Filed: Apr. 2, 2003

(65) Prior Publication Data

US 2003/0223768 A1 Dec. 4, 2003

(30) Foreign Application Priority Data

Feb. 25, 2003 (JP) ..... 2003-047623

(51) Int. Cl.[7] ..... G03G 15/16
(52) U.S. Cl. ..... 399/66; 399/302; 399/308
(58) Field of Search ..... 399/302, 308, 399/66, 162, 165, 169, 301, 303, 313, 329; 198/804, 810.01, 810.03

(56) References Cited

U.S. PATENT DOCUMENTS 5,872,586 A * 2/1999 Shio ..... 399/301 X
6,061,543 A * 5/2000 Kayahara et al. ..... 399/302
6,336,025 B1 * 1/2002 Saeki ..... 399/301
6,351,622 B1 * 2/2002 Sadowara ..... 399/167
6,393,244 B1 * 5/2002 Nakayasu et al. ..... 399/301
2004/0022557 A1 * 2/2004 Kudo ..... 399/167

FOREIGN PATENT DOCUMENTS

| | | | |
|---|---|---|---|
| JP | 06-027829 | * | 2/1994 |
| JP | 07-036249 | * | 2/1995 |
| JP | 2001-005527 | * | 1/2001 |
| JP | 3186610 | | 5/2001 |
| JP | 2001-125391 | * | 5/2001 |
| JP | 2002-014506 | * | 1/2002 |
| JP | 2002-251079 | * | 9/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A belt apparatus including a belt configured to rotate around a plurality of belt rollers, a belt speed detection system configured to detect a speed of the belt, and a contact roller configured to contact the belt. A control device is configured to control the contact roller based on a detected speed of the belt. An image forming apparatus includes an image forming part configured to form an image, a first image transfer device, a transfer belt configured to rotate around a plurality of belt rollers and to hold the image transferred by the first image transfer device, a transfer belt speed detection system configured to detect a speed of the transfer belt, and a second transfer roller configured to transfer the image held on the transfer belt to a paper. A control device configured to control the second transfer roller based on a detected speed of the transfer belt.

23 Claims, 10 Drawing Sheets

BELT APPARATUS AND IMAGE FORMING APPARATUS

CROSS-REFERENCE TO RELATED APPLICATIONS

The present application claims priority to Japanese Patent Application No. 2002-103028 filed in the Japanese Patent Office on Apr. 4, 2002, Japanese Patent Application No. 2002-103032 filed in the Japanese Patent Office on Apr. 4, 2002, and Japanese Patent Application No. 2003-47623 filed in the Japanese Patent Office on Feb. 25, 2003, the disclosures of which are incorporated by reference herein in their entirety.

BACKGROUND OF THE INVENTION

1. Field of the Invention

The present invention relates to a belt apparatus and an image forming apparatus such as a copier, a facsimile machine, a printer, or other similar image forming apparatus.

2. Description of the Related Art

Recently, the market is demanding color printers and color copiers. Such color printers and copiers are conventionally either a one drum type, which includes plural developing devices positioned around a photo conductor, or a tandem type having each developing device positioned around each photo conductor. The one drum type has an advantage in that it is comparatively smaller than the tandem type and has a reduced cost. On the other hand, the tandem type has an advantage that it can provide increased copying or printing speed.

In the field of a color electronography, the tandem type device is recently used because a speed demand of the color electronography is required to be the same as with monochoromatic electronography. An example of the conventional tandem type device is explained by reference to FIGS. 9–11. FIG. 9 is a perspective view of an image forming apparatus of a direct transfer type, and FIG. 10 is a side view of the device shown in FIG. 9, while FIG. 11 is a side view of an image forming apparatus of an indirect transfer type.

As shown in FIGS. 9 and 10, photo conductors 100K, 100Y, 100C and 100M of the direct transfer type device are disposed in a straight line along a conveyance belt 500 that conveys a paper 400. Each motor 100*a* drives a respective photo conductor 100K, 100Y, 100C, and 100M. The conveyance belt 500 is stretched between a driven roller 501 that is driven by motor 501 a, and a roller 502. As seen in FIG. 10, the direct transfer type device includes a feed device 700 and a fixing device 800. The paper 400 is moved by the feed device 700 to the belt 500, where color toner images are formed on the paper 400 by each of the photo conductors 100K, 100Y, 100C and 100M. The paper with the toner image is then moved by the belt 500 to the fixing device 800, where the toner image is fixed to the paper.

As shown in FIG. 11, photo conductors 100K, 100Y, 100C and 100M of the indirect transfer type are disposed in a straight line along an intermediate transfer belt 600. The intermediate belt 600 is stretched around a driven roller 201, and rollers 202 and 203. Color toner images are superimposed over one another onto the intermediate transfer belt 600. A multicolor toner image on the intermediate transfer belt 600 is then transferred to a paper by way of a second transfer device 300. As with the direct transfer device, the device of FIG. 11 includes a feed device 900 and a fixing device 1000. A paper is moved by the feed device 900 to a transfer part 1100 at a nip between the roller 203 and the second fixing device 300, where the multicolor toner image is formed on the paper. The paper with the toner image is then moved to the fixing device 1000, where the toner image is fixed to the paper.

Comparing the direct transfer type with the indirect transfer type, the size of conveyance distance of the direct transfer type device is bigger than the size of the conveyance distance of the indirect transfer type device. Specifically, as seen in FIG. 10, a paper feed part 700 and a fix part 800 of the direct transfer type is required to be positioned beside the conveyance belt 500. On the other hand, the indirect transfer type device shown in FIG. 11 allows the paper feed part 900 and the fixing part 1000 to be disposed under the intermediate transfer belt 600. This positioning under the intermediate transfer belt 600 allows the conveyance distance from the feed device to the fixing device of the indirect device to be smaller than that of a direct transfer device.

Further, in order to minimize the conveyance distance of the direct transfer type device in FIGS. 9 and 10, the fixing part 800 is located very close to the conveyance belt 500. This configuration causes the fixing device 800 to influence the image formed on the paper 400 by the photo conductor 100K. On the other hand, the fixing device 1000 of the indirect transfer type device does not influence the image formation because a relatively large space is provided between the fixing part 1000 and a transfer part 1100. Therefore, the indirect transfer type device is generally preferred over the direct transfer device in terms of image quality.

In addition, both the direct and indirect transfer devices have a problem in that it is difficult to superimpose color toner images over one another in a multicolor image because the speed of the belt of these devices changes. Therefore, Japanese Registered Patent No.3186610 bulletin discloses a device that can control the speed of a photo conductor and a conveyance belt based on data obtained from detecting a pattern formed on the belt. However, when a second transfer device of the disclosed device has a change of speed, the change affects the first and the second transfers. Further, if the change is too big, speed of the intermediate transfer belt becomes out of control.

SUMMARY OF THE INVENTION

An object of the present invention is to reduce or solve any or all of the above-described problems.

A more specific object of the present invention is to provide an indirect transfer belt apparatus or image forming apparatus that can control the change of speed of a second transfer device.

These and other objects of the present invention are provided by a belt apparatus including a belt configured to rotate around a plurality of belt rollers, a belt speed detection system configured to detect a speed of the belt, a contact roller configured to contact the belt, and a control device configured to control the contact roller based on a detected speed of the belt.

In another aspect of the present invention, an image forming apparatus includes an image forming part configured to form an image, a first image transfer device, a transfer belt configured to rotate around a plurality of belt rollers and to hold the image transferred by the first image transfer device, a transfer belt speed detection system configured to detect a speed of the transfer belt, a second transfer roller configured to transfer the image held on the transfer belt to a paper, and a control device configured to control the second transfer roller based on a detected speed of the transfer belt.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings.

DETAILED DESCRIPTION OF THE PREFERRED EMBODIMENTS

Figure 1:
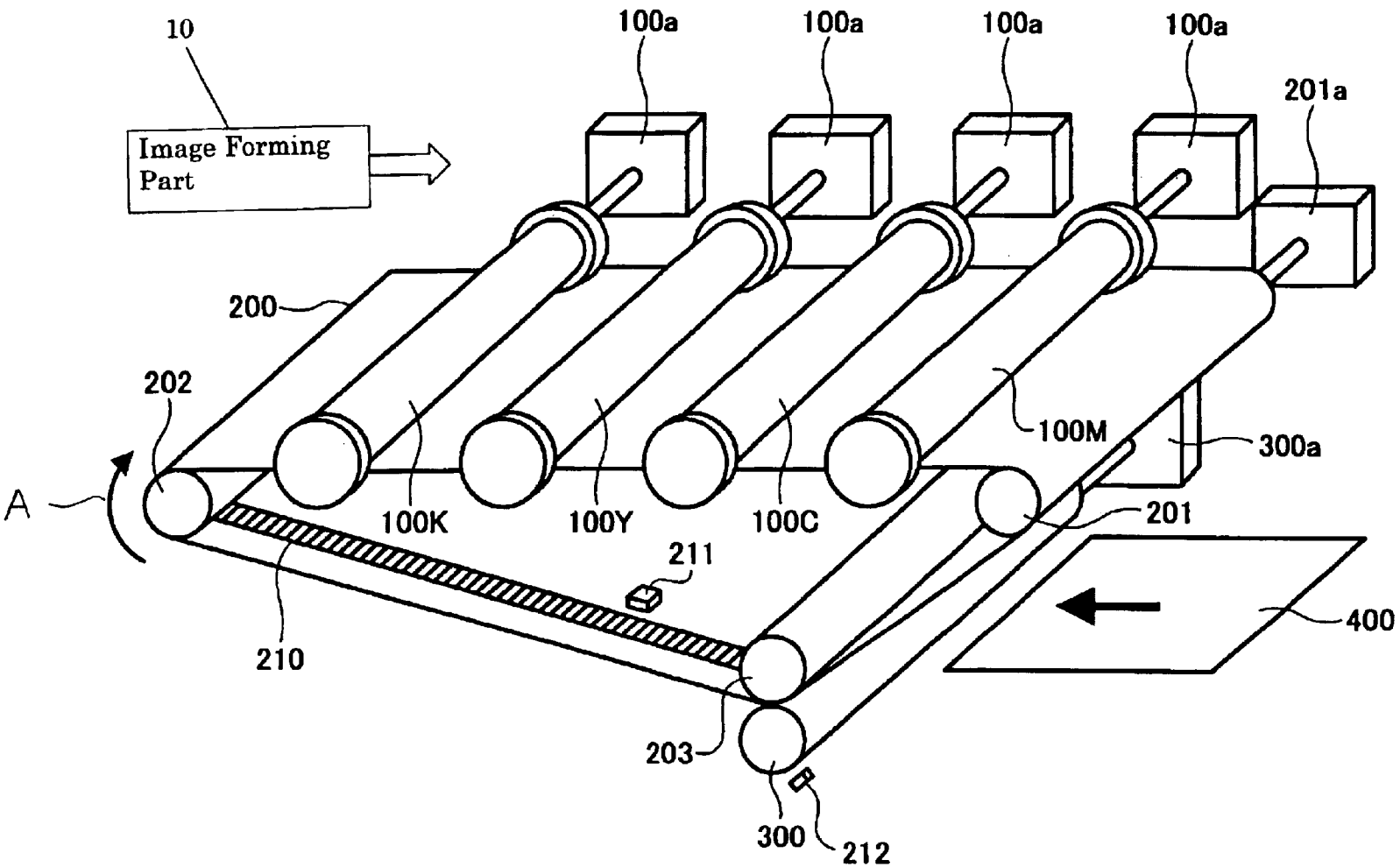
FIG. 1 is a perspective view of an image forming apparatus in accordance with a first embodiment of the present invention.
Figure 2:
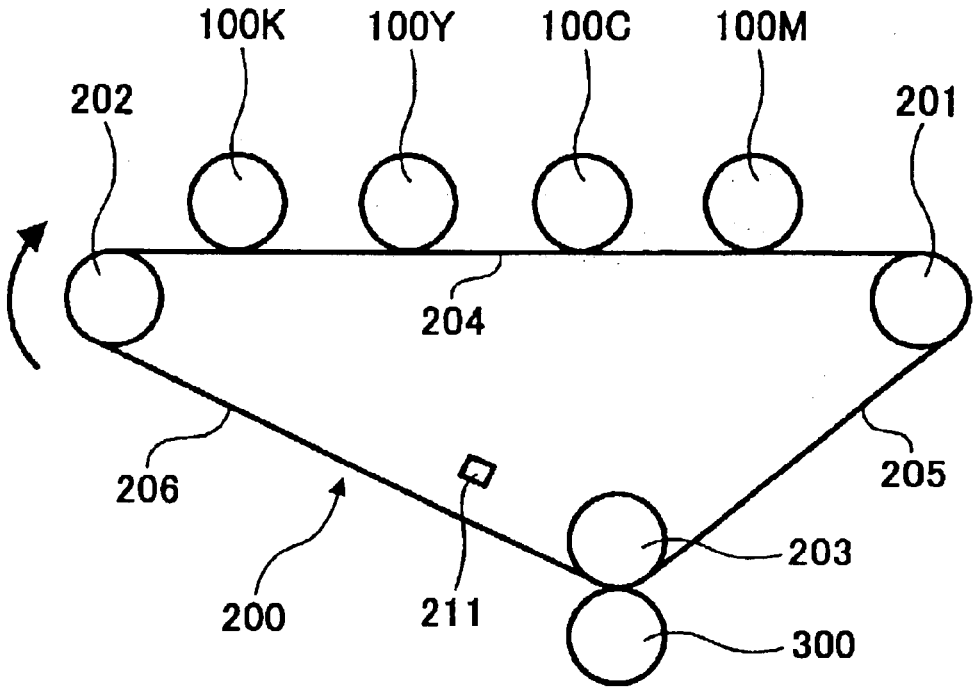
FIG. 2 is a side view of the image forming device of FIG. 1.

Referring now to the drawings wherein like reference numerals designate identical or corresponding parts throughout the several views, FIG. 1 is a perspective view of an image forming apparatus in accordance with a first embodiment of the present invention, and FIG. 2 is a side view of the image forming device of FIG. 1. As seen in these figures, the image forming apparatus of this embodiment includes photo conductors 100K, 100Y, 100C, and 100M positioned along an image transfer belt 200. The photoconductors carry latent images formed by the image forming part 10. Each of the motors 100*a* drives a respective photo conductor. The photo conductors 100K, 100Y, 100C and 100M contain black, yellow, cyan and magenta toner, respectively. When the intermediate transfer belt 200 rotates in direction of arrow A, each black, yellow, cyan, magenta toners are transferred to the intermediate transfer belt 200 such that each color is overlapped to form a multicolor image. The intermediate transfer belt 200 is stretched around driven roller 201, roller 202 and pressure roller 203. The driven roller 201 is driven by motor 201 a. A second transfer roller 300 is positioned opposing the pressure roller 203 with the intermediate transfer belt 200 interposed therebetween. The second transfer roller 300 is controlled by a motor 300*a* based on a speed of the intermediate transfer belt 200 as will be described below.

As best seen in FIG. 2, the driven roller 201, roller 202, and pressure roller 203 stretch the intermediate transfer belt 200 to form three plane parts 204, 205, 206. The photo conductors 100K, 100Y, 100C, 100M are located along the plane part 204, between the roller 201 and the roller 202. A detect sensor 211 located in the plane part 206 in a downstream position of the pressing roller 203 reads a speed detective pattern 210 formed on the intermediate transfer belt 200 for detecting the speed of the intermediate transfer belt 200. The speed detecting sensor 211 is disposed downstream of the pressure roller 203 in a direction of rotation of the intermediate transfer belt 200. Because the location of the sensor 211 is near the second transfer roller 300, the sensor 211 can detect the speed of the belt 200 near the second transfer roller 300, and a linear control becomes possible. The present inventors have determined that if a sensor is disposed near the plane part 205 close to the driven roller 201, the tension of the intermediate transfer belt 200 is not constant in this area and the sensor 211 cannot precisely detect a speed of the belt. On the other hand, the tension is constant in the plane part 206, which is the reason why the sensor 211 is located near the plane part 206. Further, the speed of the second transfer roller 300 can be controlled precisely because the sensor 211 is located near the second transfer roller 300.

As also seen in FIGS. 1 and 2, a sensor 212 is positioned adjacent to the roller 300 to detect a speed of the roller. In one embodiment, the sensor 212 is part of an encoder system provided on the second transfer roller 300. The encoder system may include an encoder pattern (not shown) provided on an edge of the second transfer roller, which the sensor 212 detects to determine a speed of the second transfer roller 300. Thus, the image forming device of the first embodiment includes a sensor 211 for detecting a speed of the intermediate transfer belt 200, and a sensor 212 for detecting the speed of the roller 300. Therefore, a difference of speed between the intermediate transfer belt 200 and the second transfer roller 300 can be determined and controlled to be substantially constant, or near zero. As a consequence, the effect of the rotation of the second transfer roller 300 on the intermediate transfer belt 200 is reduced by the present invention.

Figure 3:
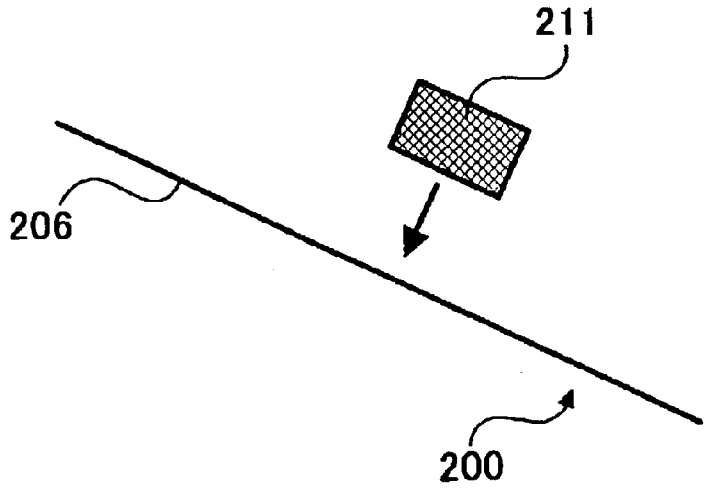
FIG. 3 is a diagram showing the relationship between the intermediate transfer belt and a detect device in accordance with the first embodiment of the present invention.

FIG. 3 is a diagram showing the relationship between the intermediate transfer belt 200 and the speed detect sensor 211 according to the first embodiment of the present invention. As seen in this figure, a reading mask of the speed detect sensor 211 is downward facing in a direction of gravity. Therefore, substances such as dirt or trash are prevented from attaching to the reading mask and the sensor 211 can detect the speed precisely. Furthermore, as shown in FIG. 1, because the speed detective pattern 210 is disposed on the backside, or inside, surface of the intermediate transfer belt 200, substances such as toner or paper powder are prevented from attaching to the speed detective pattern 210 and the sensor can detect the speed precisely.

Figure 4:
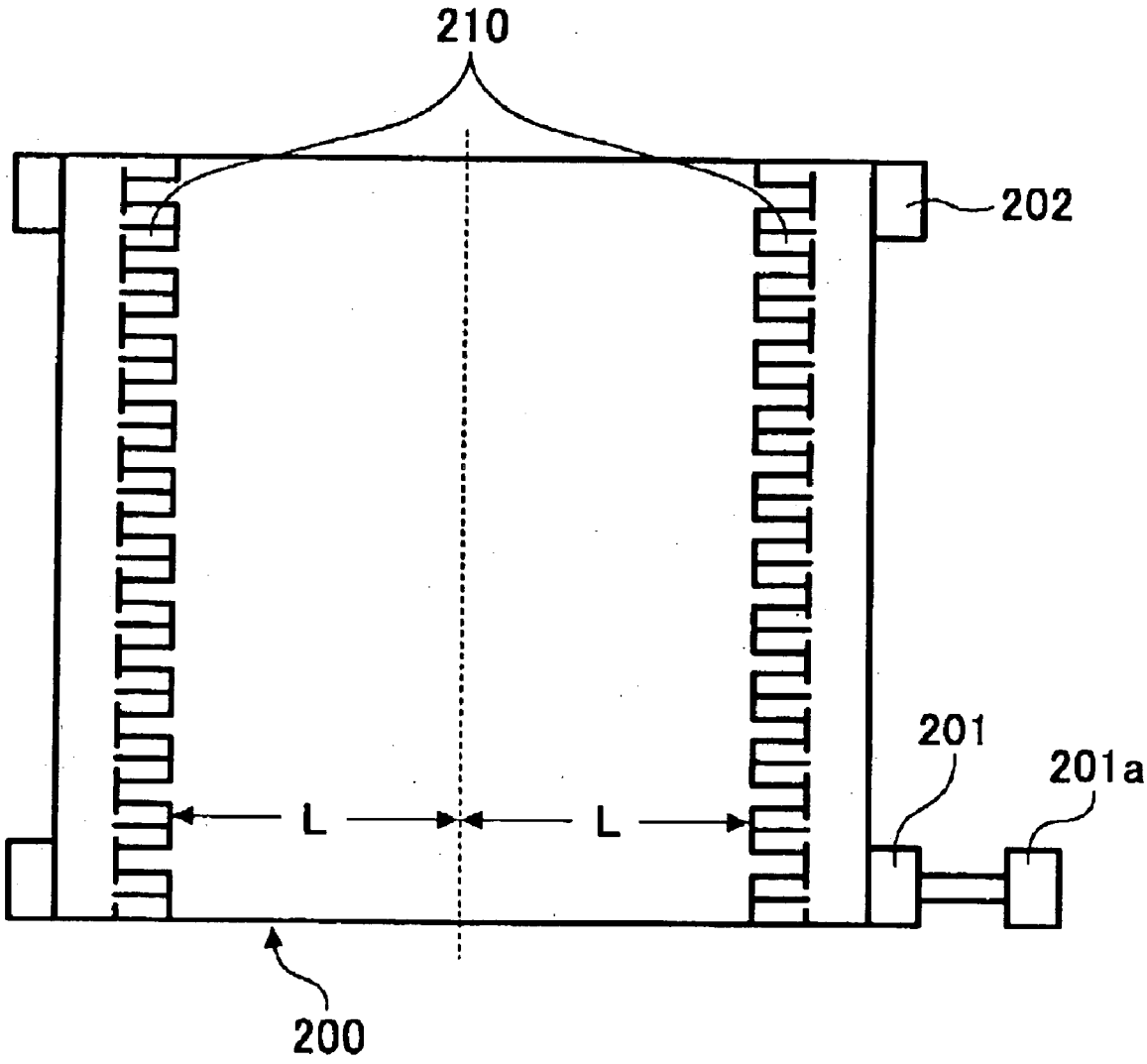
FIG. 4 is a diagram showing a speed detection pattern on the intermediate transfer belt in accordance with the first embodiment of the present invention.

FIG. 4 is a diagram showing a speed detection pattern on the intermediate transfer belt according to an embodiment of the invention. As shown in FIG. 4, the speed detection pattern 210 includes two patterns each disposed a distance L apart from the center of the intermediate transfer belt 200. In a preferred embodiment, each pattern is detected by a sensor and a speed of the intermediate transfer belt 200 is determined for each pattern. A difference between the detected speed of the two patterns is caused by meandering of the intermediate transfer belt 200. When this difference is too large, the image forming device determines which of the detected speeds corresponds to a normal speed of the intermediate transfer belt, and disregards the other detected speed as an error output. Therefore, the sensor 211 can detect the speed precisely by utilizing two different speed detection patterns on the intermediate transfer belt 200.

Figure 5:
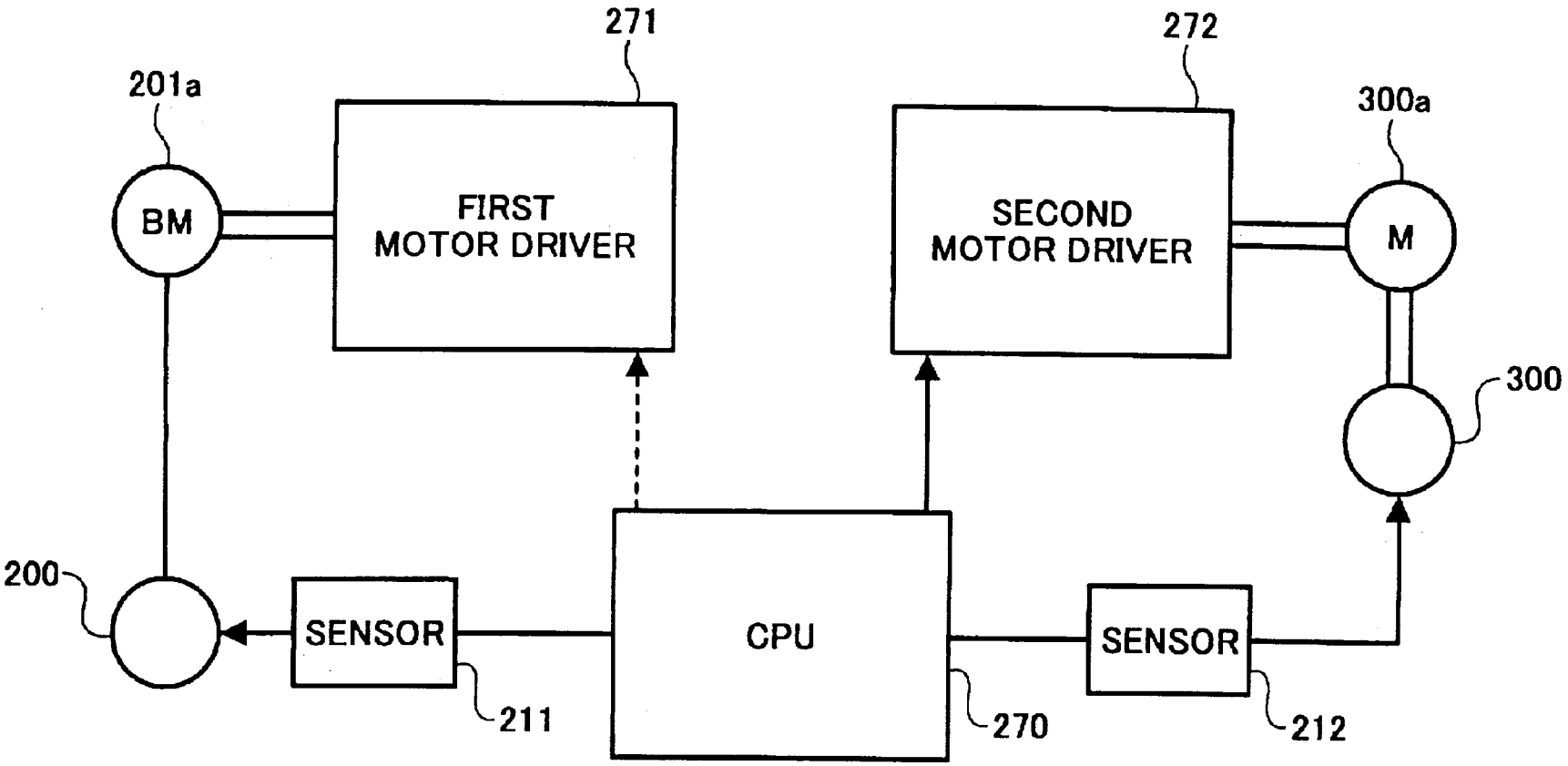
FIG. 5 is a block diagram showing a control system in accordance with the first embodiment of the invention.

FIG. 5 is a block diagram showing a control system of the image forming device in accordance with the first embodiment of the present invention. As seen in this figure, the control device includes a CPU, a first motor driver 271, and a second motor driver 272. The first motor driver 271 controls a first drive motor 201*a*, which drives the driven roller 201 for rotating the intermediate transfer belt 200, as previously described. The speed detect sensor 211 detects the detect pattern 210 on the intermediate transfer belt 200 and provides a detected output to CPU 270. The CPU 270 calculates the speed of the intermediate transfer belt 200 and commands the motor driver 271 to drive the drive motor 201*a* in the regulation speed. Similarly, the second motor driver 272 controls a second drive motor 300*a*, which drives the second transfer roller 300 while the sensor 212 detects an encoder pattern on the roller 300.

Upon receiving the input signals from the sensors 211 and 212, the CPU 270 compares a input signal of the sensor 212 with a input signal of the sensor 211 and calculates the difference of speed between the intermediate transfer belt 200 and the second transfer roller 300. The CPU 270 then commands the motor driver 272 to eliminate this difference. Therefore, the speed of the intermediate transfer belt 200 corresponds to the speed of the second transfer roller 300 by repeating a feedback control. As a consequence, the irregular rotation of the second transfer belt 200 can be controlled.

Figure 6:
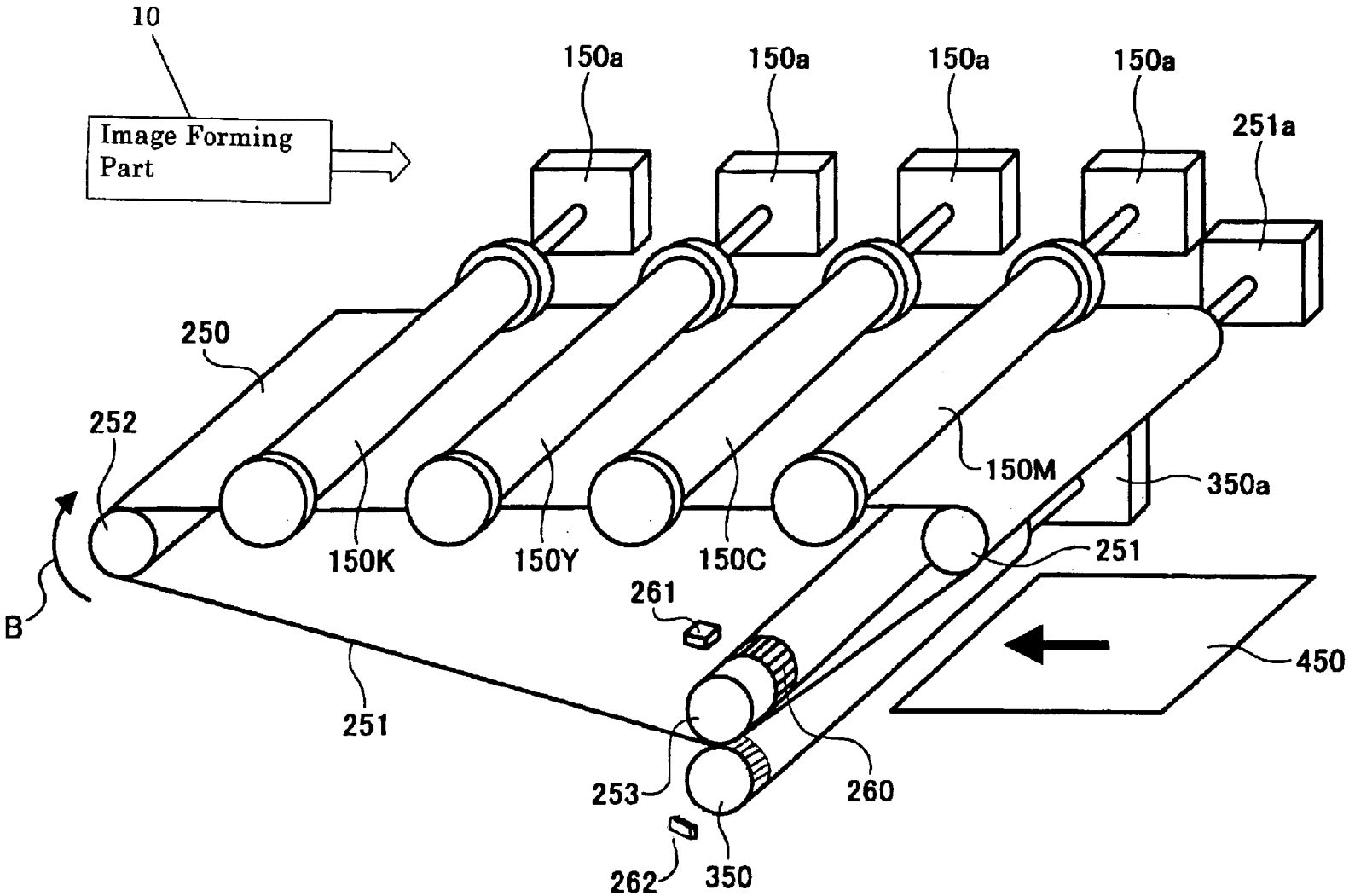
FIG. 6 is a perspective view of an image forming apparatus in accordance with a second embodiment of the present invention.
Figure 7:
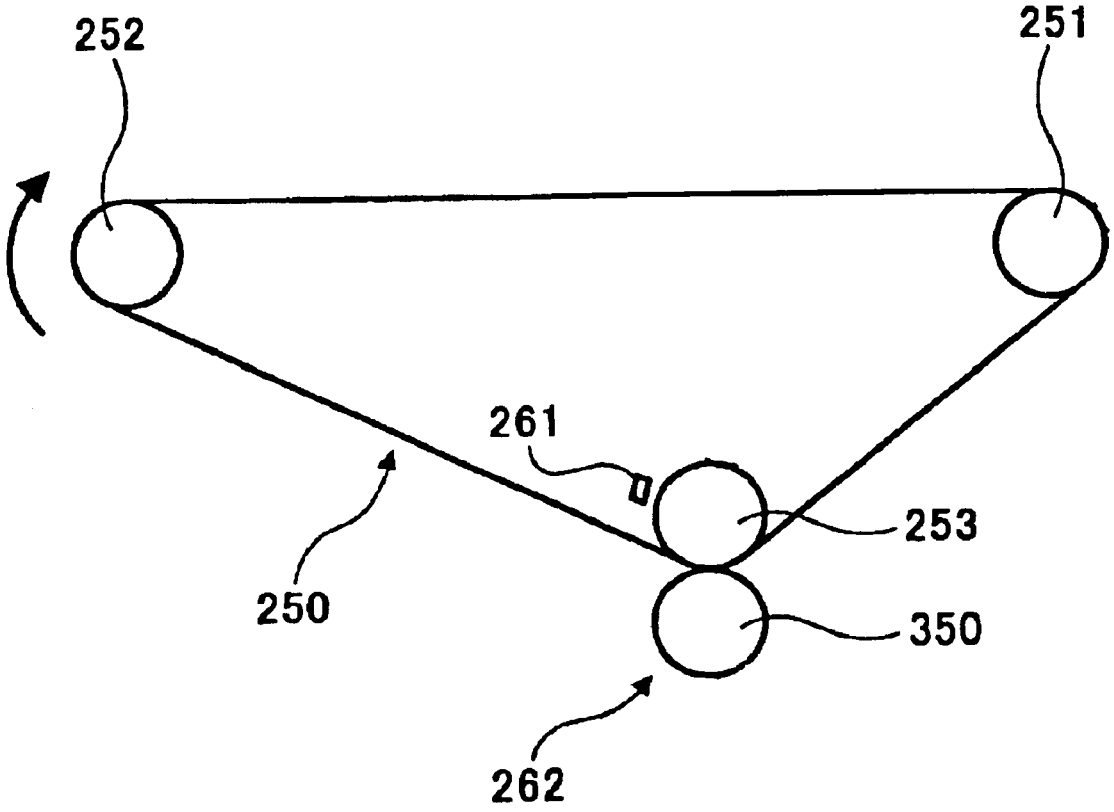
FIG. 7 is a side view of the device shown in FIG. 6.

FIG. 6 is a perspective view of an image forming apparatus in accordance with a second embodiment of the present invention, and FIG. 7 is a side view of the image forming device of FIG. 6. As seen in these Figures, the image forming apparatus of this embodiment includes photo conductors 150K, 150Y, 150C, and 150M positioned along an image transfer belt 251. The photoconductors carry latent images formed by the image forming part 10. Each of the motors 150*a* drives a respective photo conductor. The photo conductors 150K, 150Y, 150C and 150M contain black, yellow, cyan and magenta toner, respectively. When the intermediate transfer belt 250 rotates in direction of arrow B, each black, yellow, cyan, magenta toners are transferred to the intermediate transfer belt 250 such that each color is overlapped to form a multicolor image that is transferred to paper 450. The intermediate transfer belt 250 is stretched around driven roller 251, roller 252 and pressure roller 253. The driven roller 251 is driven by motor 251*a*. A second transfer roller 350 is positioned opposing the pressure roller 253 with the intermediate transfer belt 250 interposed therebetween. The second transfer roller 350 is controlled by a motor 350*a* based on a speed of the intermediate transfer belt 250 as will be described below.

As also seen in FIGS. 6 and 7, a sensor 261 is positioned adjacent to the pressing roller 253 to detect a speed of the roller 253, and a sensor 262 is positioned adjacent to the roller 350 to detect a speed of this roller. In one embodiment, an encoder pattern 260 is disposed on the outer circumference of the pressing roller 253 and the second transfer roller 350 and the sensors 261 and 262 detect the encoder patterns. In another embodiment, the encoder pattern may be formed on an edge of the rollers 253. Thus, the image forming device of the second embodiment detects a speed of the pressing roller 253 and the second transfer roller 350. Therefore, a difference of speed between the pressing roller 253 and the second transfer roller 350 can be determined and controlled to be substantially constant, or near zero. As a consequence, the effect of the rotation of the second transfer roller 350 on the intermediate transfer belt 250 is reduced by the present invention.

Figure 8:
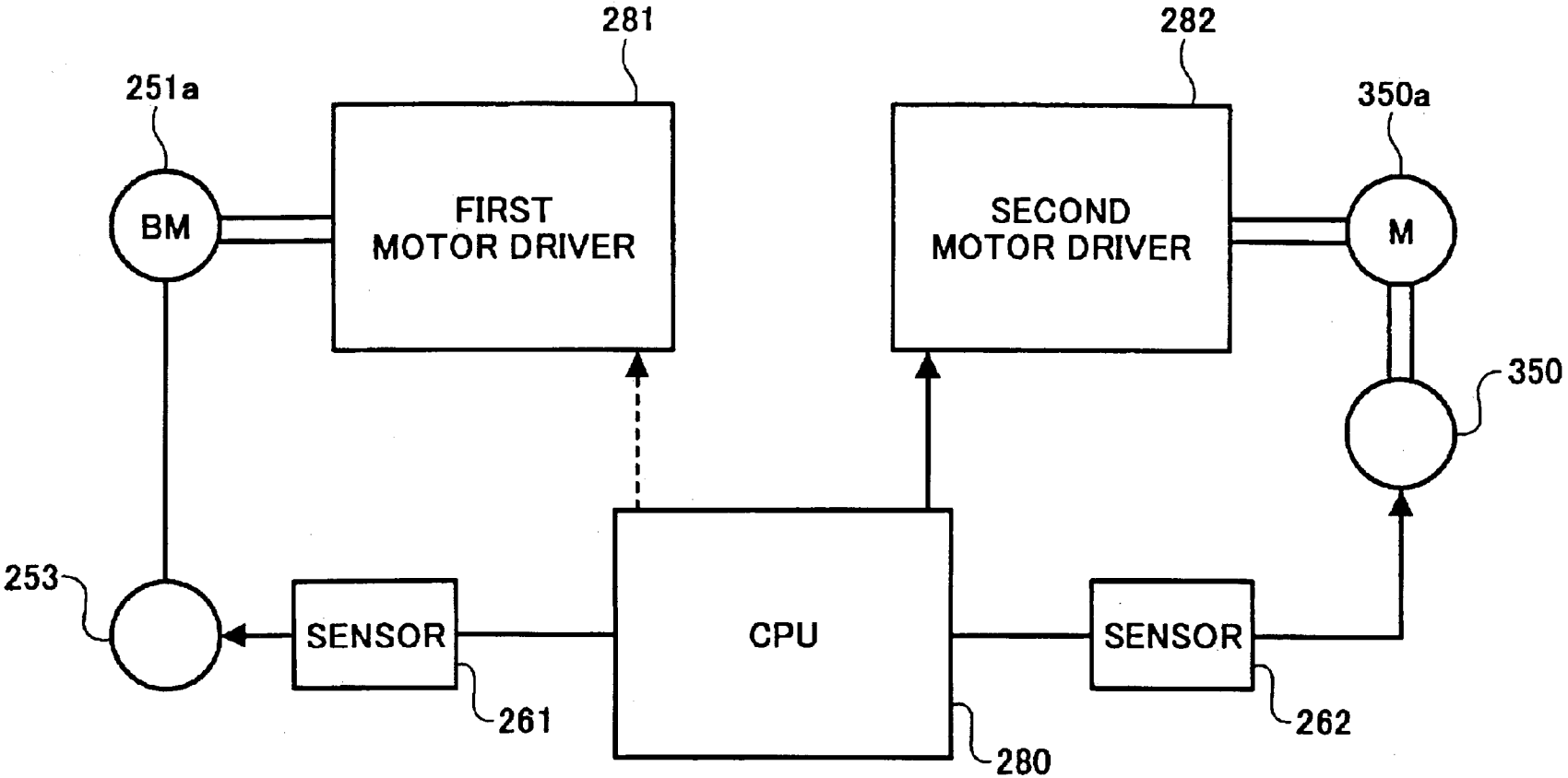
FIG. 8 is a block diagram showing a control system in accordance with the second embodiment of the present invention.
Figure 9:
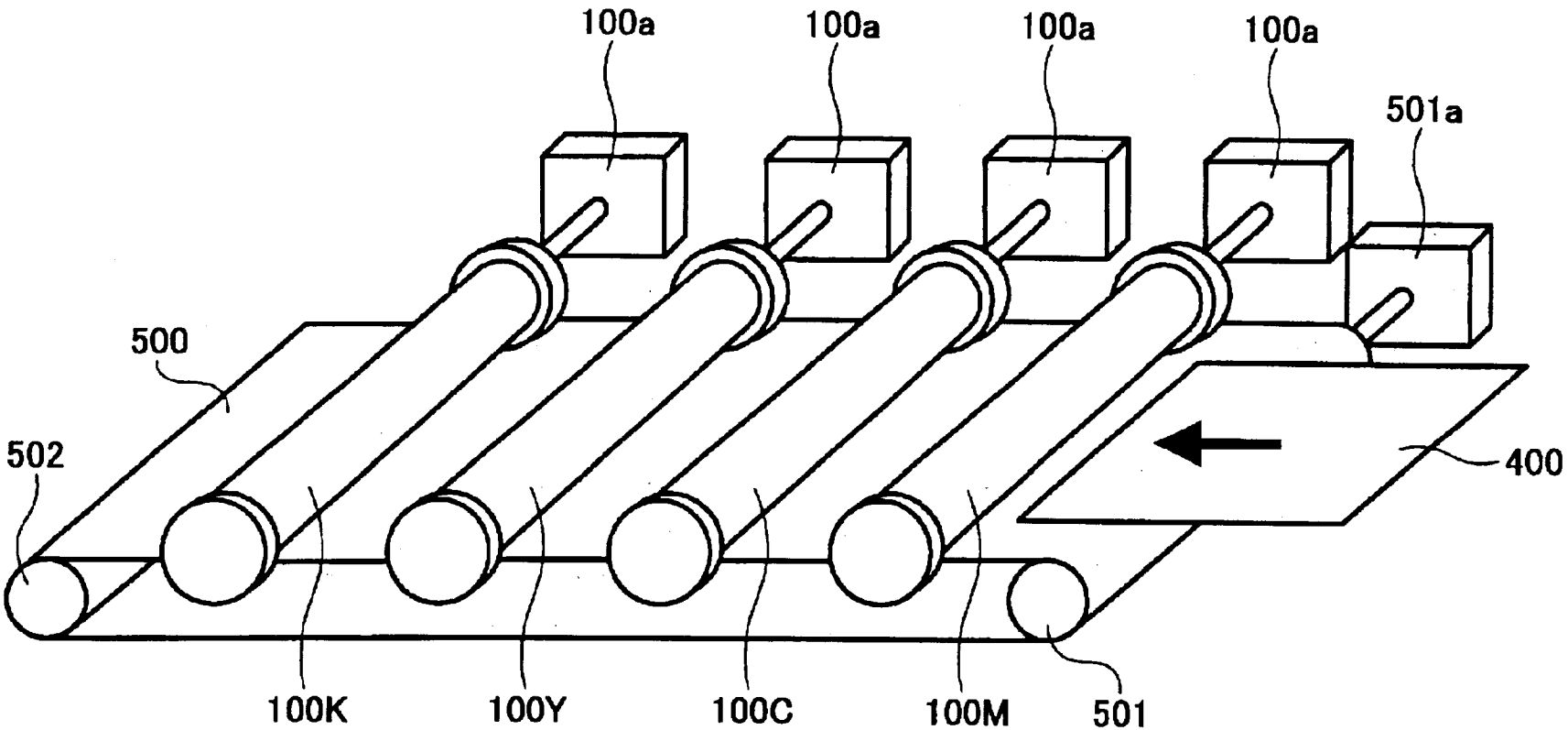
FIG. 9 PRIOR ART
FIG. 9 is a perspective view of an image forming apparatus of a direct transfer type device.
Figure 10:
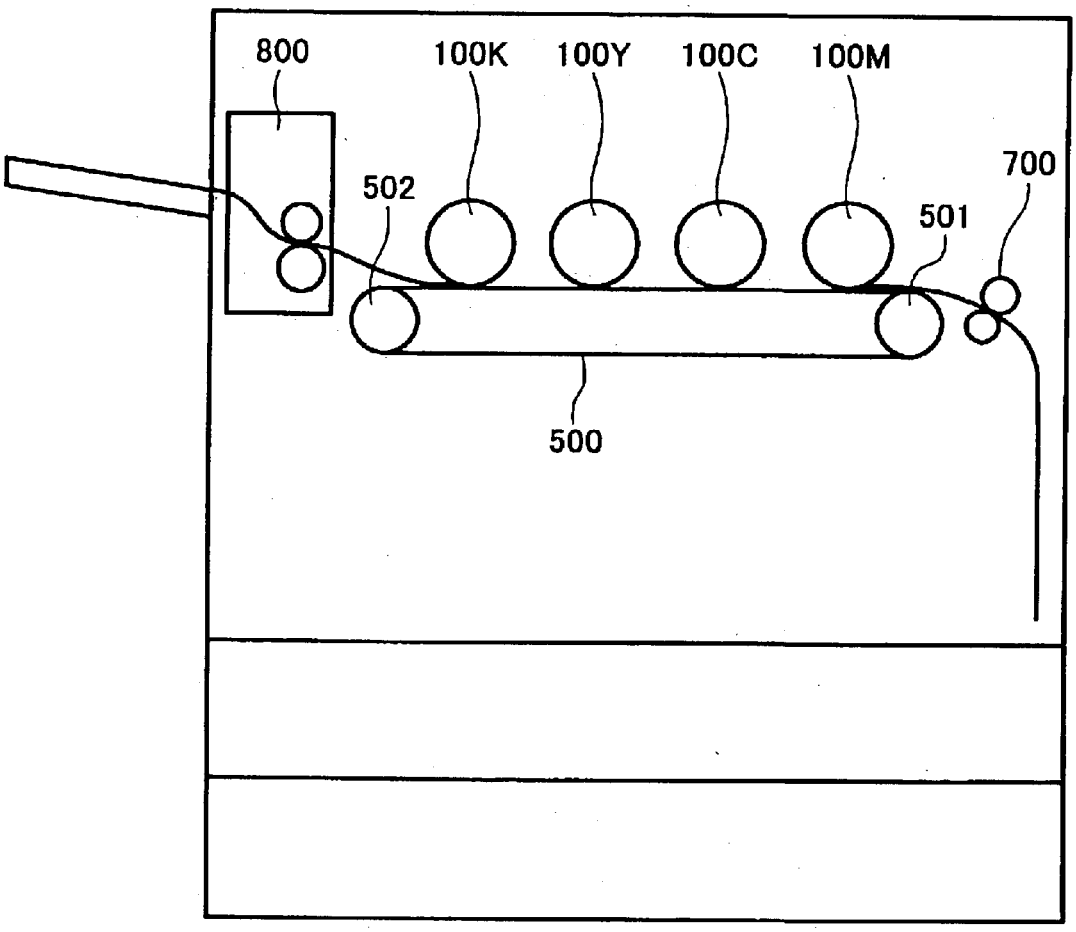
FIG. 10 PRIOR ART
FIG. 10 is a side view of the device shown in FIG. 9.
Figure 11:
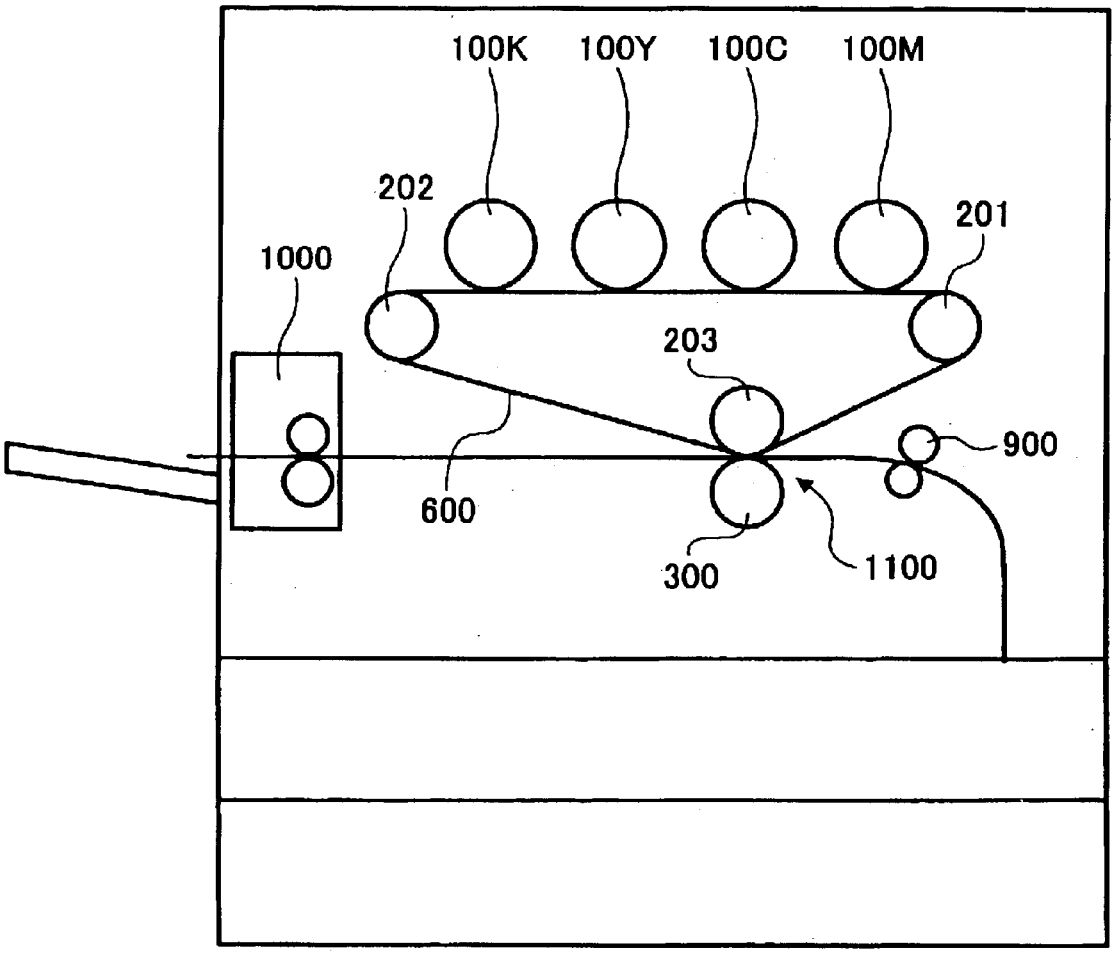
FIG. 11 PRIOR ART
FIG. 11 is a side view of an image forming apparatus of an indirect transfer type.

FIG. 8 is a block diagram showing a control system of the image forming device in accordance with the second embodiment of the present invention. As seen in this figure, the control device includes a CPU 280, a first motor driver 281, and a second motor driver 282. The first motor driver 281 controls a first drive motor 251*a*, which drives the driven roller 251 for rotating the intermediate transfer belt 250, as previously described. When the intermediate transfer belt 250 rotates, the pressure roller 253 also rotates. The speed detect sensor 261 detects the detect pattern on the pressure roller 253 and provides a detected output to CPU 280. The CPU 280 calculates the speed of the intermediate transfer belt 250 by way of the roller 253, and commands the motor driver 251 to drive the drive motor 251*a* in the regulation speed. Similarly, the second motor driver 282 controls the second drive motor 350*a*, which drives the second transfer roller 350 while the sensor 262 detects an encoder pattern on the roller 350.

Upon receiving the input signals from the sensors 261 and 262, the CPU 280 compares a input signal of the sensor 262 with an input signal of the sensor 261 and calculates the difference of speed between the intermediate transfer belt 250 and the second transfer roller 350. The CPU 280 then commands the motor driver 282 to eliminate this difference. Therefore, the speed of the intermediate transfer belt 250 corresponds to the speed of the second transfer roller 350 by repeating a feedback control. As a consequence, the irregular rotation of the second transfer belt 250 can be controlled. Further, instead of the position of the outer circumference of the roller, a speed detect pattern can be disposed the edge of the pressure roller instead of on the circumference of the pressure roller.

Obviously, numerous modifications and variations of the present invention are possible in light of the above teachings. It is therefore to be understood that within the scope of the appended claims, the invention may be practiced otherwise than as specifically described herein.

What is claimed is:

1. An indirect transfer belt apparatus, comprising:

a belt configured to rotate around a plurality of belt rollers;

a contact roller configured to contact the belt;

a belt speed detection system configured to detect a speed of the belt, wherein the detection system comprises:

a speed detect pattern positioned on the belt; and a sensor positioned downstream of the contact roller in a direction of rotation of the belt and configured to read the speed detect pattern; and a control device configured to control the contact roller based on a detected speed of the belt.

2. The belt apparatus of claim 1, wherein said sensor comprises a reading mask that faces downward in a direction of gravity.

3. The belt apparatus of claim 1, wherein the speed detect pattern is disposed on an inside surface of the belt in contact with the plurality of belt rollers.

4. The belt apparatus of claim 1, wherein the speed detect pattern comprises a plurality of detection patterns positioned along a direction of a width of the belt.

5. The belt apparatus of claim 1, wherein said control device comprises a processor configured to control a motor that drives the contact roller, based on the detected speed of the belt.

6. The belt apparatus of claim 5, wherein said control device further comprises a contact roller speed detection system configured to detect a speed of the contact roller.

7. The belt apparatus of claim 6, wherein the contact roller speed detection system comprises:

a speed detect pattern positioned on an outer circumference of the contact roller; and a sensor configured to read the speed detect pattern, said sensor being disposed near the contact roller, wherein said processor controls the motor that drives the contact roller based on the detected speed of the belt and the contact roller.

8. The belt apparatus of claim 7, wherein said sensor comprises a reading mask that faces downward in a direction of gravity.

9. An image forming apparatus comprising:

an image forming part configured to form an image;

a first image transfer device;

an indirect transfer belt configured to rotate around a plurality of belt rollers and to hold the image transferred by the first image transfer device;

a second transfer roller configured to transfer the image held on the transfer belt to a paper;

a transfer belt speed detection system configured to detect a speed of the transfer belt, wherein the speed detection system comprises:

a speed detect pattern positioned on the transfer belt; and a sensor positioned downstream of the second transfer roller in a direction of rotation of the belt and configured to read the speed detect pattern; and a control device configured to control the second transfer roller based on a detected speed of the transfer belt.

10. The image forming apparatus of claim 9, wherein said sensor comprises a reading mask that faces downward in a direction of gravity.

11. The image forming apparatus of claim 9, wherein the speed detect pattern is disposed on an inside surface of the transfer belt in contact with the plurality of belt rollers.

12. The image forming apparatus of claim 9, wherein the speed detect pattern comprises a plurality of detection patterns positioned along a direction of a width of the transfer belt.

13. The image forming apparatus of claim 9 further comprising a pressure roller opposing the second transfer roller with the transfer belt interposed therebetween such that the pressure roller supports the transfer belt.

14. The image forming apparatus of claim 13, wherein the detection system comprises:

a speed detect pattern positioned on an outer circumference of the pressure roller; and a sensor configured to read the speed detect pattern, said sensor being disposed near the pressure roller.

15. The image forming apparatus of claim 14, wherein said sensor comprises a reading mask that faces downward in a direction of gravity.

16. The image forming apparatus of claim 9 wherein said control device comprises a processor configured to control a motor that drives the second transfer roller, based on the detected speed of the transfer belt.

17. The image forming apparatus of claim 16, wherein said control device further comprises a second transfer roller speed detection system configured to detect a speed of the second transfer roller.

18. The image forming apparatus of claim 17, wherein the second transfer roller speed detection system comprises:

a speed detect pattern positioned on an outer circumference of the second transfer roller; and a sensor configured to read the speed detect pattern, said sensor being disposed near the second transfer roller, wherein said processor controls the motor that drives the second transfer roller based on the detected speed of the transfer belt and the second transfer roller.

19. The image forming apparatus of claim 18, wherein said sensor comprises a reading mask that faces downward in a direction of gravity.

20. An indirect transfer belt apparatus comprising:

a belt configured to rotate around a plurality of belt rollers;

a contact roller configured to contact the belt;

a pressure roller opposing the contact roller with the belt interposed therebetween such that the pressure roller supports the belt;

a belt speed detection system configured to detect a speed of the belt, wherein the detection system comprises:

a speed detect pattern positioned on an outer circumference of the pressure roller; and a sensor configured to read the speed detect pattern, said sensor being disposed near the pressure roller; and a control device configured to control the contact roller based on a detected speed of the belt, wherein said control device comprises a processor configured to control a motor that drives the contact roller, based on the detected speed of the belt.

21. The belt apparatus of claim 20, wherein said control device further comprises a contact roller speed detection system configured to detect a speed of the contact roller.

22. The belt apparatus of claim 21, wherein the contact roller speed detection system comprises:

a speed detect pattern positioned on an outer circumference of the contact roller; and a sensor configured to read the speed detect pattern, said sensor being disposed near the contact roller, wherein said processor controls the motor that drives the contact roller based on the detected speed of the belt and the contact roller.

23. The belt apparatus of claim 22, wherein said sensor comprises a reading mask that faces downward in a direction of gravity.

* * * * *

UNITED STATES PATENT AND TRADEMARK OFFICE

CERTIFICATE OF CORRECTION

PATENT NO. : 6,898,386 B2
DATED : May 24, 2005
INVENTOR(S) : Takigawa

It is certified that error appears in the above-identified patent and that said Letters Patent is hereby corrected as shown below:

Title page,
Item [30], should read:
-- [30] Foreign Application Priority Data
Apr. 4, 2002 (JP) ……. 2002-103032
Apr. 4, 2002 (JP) ……. 2002-103028
Feb. 25, 2003 (JP) ……. 2003-047623 --

Signed and Sealed this

Twelfth Day of July, 2005

JON W. DUDAS
*Director of the United States Patent and Trademark Office*